US008087600B2

(12) United States Patent
Pan et al.

(10) Patent No.: US 8,087,600 B2
(45) Date of Patent: Jan. 3, 2012

(54) FOOD WASTE DISPOSAL UNIT

(75) Inventors: Ji Cheng Pan, Shenzhen (CN); Israr Ahmed Khan Saeed, Hong Kong (CN); Kwong Yip Poon, Hong Kong (CN)

(73) Assignee: Johnson Electric S.A., Chaux-de-Fonds (CH)

( * ) Notice: Subject to any disclaimer, the term of this patent is extended or adjusted under 35 U.S.C. 154(b) by 0 days.

(21) Appl. No.: 12/112,600

(22) Filed: Apr. 30, 2008

(65) Prior Publication Data

US 2008/0265071 A1 Oct. 30, 2008

(30) Foreign Application Priority Data

Apr. 30, 2007 (CN) ..... 2007 1 0102345

(51) Int. Cl.
*B02C 23/36* (2006.01)

(52) U.S. Cl. ..... 241/46.014

(58) Field of Classification Search . 241/46.013–46.016
See application file for complete search history.

(56) References Cited

U.S. PATENT DOCUMENTS

| | | | | |
|---|---|---|---|---|
| 2,719,011 | A | 9/1955 | Bebinger | |
| 2,939,639 | A * | 6/1960 | Coss | 241/46.015 |
| 2,977,054 | A | 3/1961 | Hyde | |
| 3,165,271 | A * | 1/1965 | Enright | 241/46.014 |
| 3,589,624 | A | 6/1971 | Smith | |
| 4,337,901 | A | 7/1982 | Ogura | |
| 5,944,268 | A * | 8/1999 | Andela | 241/99 |
| 2003/0066914 | A1 | 4/2003 | Jara-Almonte et al. | |

FOREIGN PATENT DOCUMENTS

| | | |
|---|---|---|
| EP | 1770226 | 4/2007 |
| GB | 2042927 | 10/1980 |

* cited by examiner

*Primary Examiner* — Mark Rosenbaum
(74) *Attorney, Agent, or Firm* — Muncy, Geissler, Olds & Lowe, PLLC

(57) ABSTRACT

A food waste disposer has a housing 12 defining a grinding chamber 14 having an inlet 16 and an outlet 18. A grinding mechanism including a shredder ring 20 and a grinding disc 22, is disposed within the grinding chamber 14. A liner 21, preferably of a plastics material, extends from the shredder ring 20 to the inlet 16. The liner 21 reduces the noise generated by the disposer when in use.

20 Claims, 4 Drawing Sheets

FOOD WASTE DISPOSAL UNIT

CROSS-REFERENCE TO RELATED APPLICATIONS

This non-provisional patent application claims priority under 35 U.S.C. §119(a) from Patent Application No. 200710102345.8 filed in China on 30 Apr. 2007.

FIELD OF THE INVENTION

This invention relates to a food waste disposal unit.

BACKGROUND

Food waste disposers, especially those designed for domestic use, are often installed under a sink where they are directly attached to the drain of the sink. As such, the disposer is located in a prime position in the kitchen.

Food waste disposal units grind up food waste so that the matter can be disposed of through the domestic sewage system. This grinding process produces considerable noise which is generally tolerated in order to complete the task but there is a desire to reduce the level of noise. Typical attempts to reduce the noise of such units has involved the wrapping of the unit in noise absorbing foam materials. This reduces the noise but there is still considerable noise coming from the grinding chamber, especially when grinding bones and other hard food waste.

The present invention aims to reduce the noise of a food waste disposal unit by reducing the amount of noise produced by the grinding chamber. This is achieved by placing a liner within the grinding chamber to prevent or limit direct contact between the hard food waste and the housing of the grinding chamber.

SUMMARY OF THE INVENTION

Accordingly, the present invention provides a food waste disposer, comprising: a housing defining a grinding chamber having an inlet and an outlet; and a grinding mechanism disposed within the housing including: a shredder ring; a grinding disc; and an electric motor, for rotating the grinding disc and having an output shaft; and a liner disposed within the grinding chamber adjacent an inner surface of the housing.

Preferably, the liner extends upwardly from an upper edge portion of the shredder ring.

Preferably, the liner extends from the shredder ring to an upper edge portion of the grinding chamber.

Preferably, the liner extends from the shredder ring to the inlet.

Preferably, the liner is in direct contact with the inner surface of the housing.

Preferably, the liner is an annular ring of plastics material.

Preferably, the plastics material is a high density plastics material.

Preferably, an inner diameter of the liner matches an inner diameter of the shredder ring.

Preferably, the grinding chamber has a portion which is conical and joins a lower cylindrical portion to the inlet, and the liner extends over the conical portion.

Alternatively, the grinding chamber has a portion which is conical and joins a lower cylindrical portion to the inlet, and the liner does not extend over the conical portion.

Preferably, the grinding disc has a number of swivel pushers for impacting on the waste.

Preferably, the shredder ring has a plurality of fingers which extend inwardly into the interior of the grinding chamber at circumferentially spaced locations, at least some of the fingers being located at a different axial spacing than the other fingers.

BRIEF DESCRIPTION OF THE DRAWINGS

Preferred embodiments of the invention will now be described, by way of example only, in which.

DETAILED DESCRIPTION OF THE PREFERRED EMBODIMENTS

Figure 1:
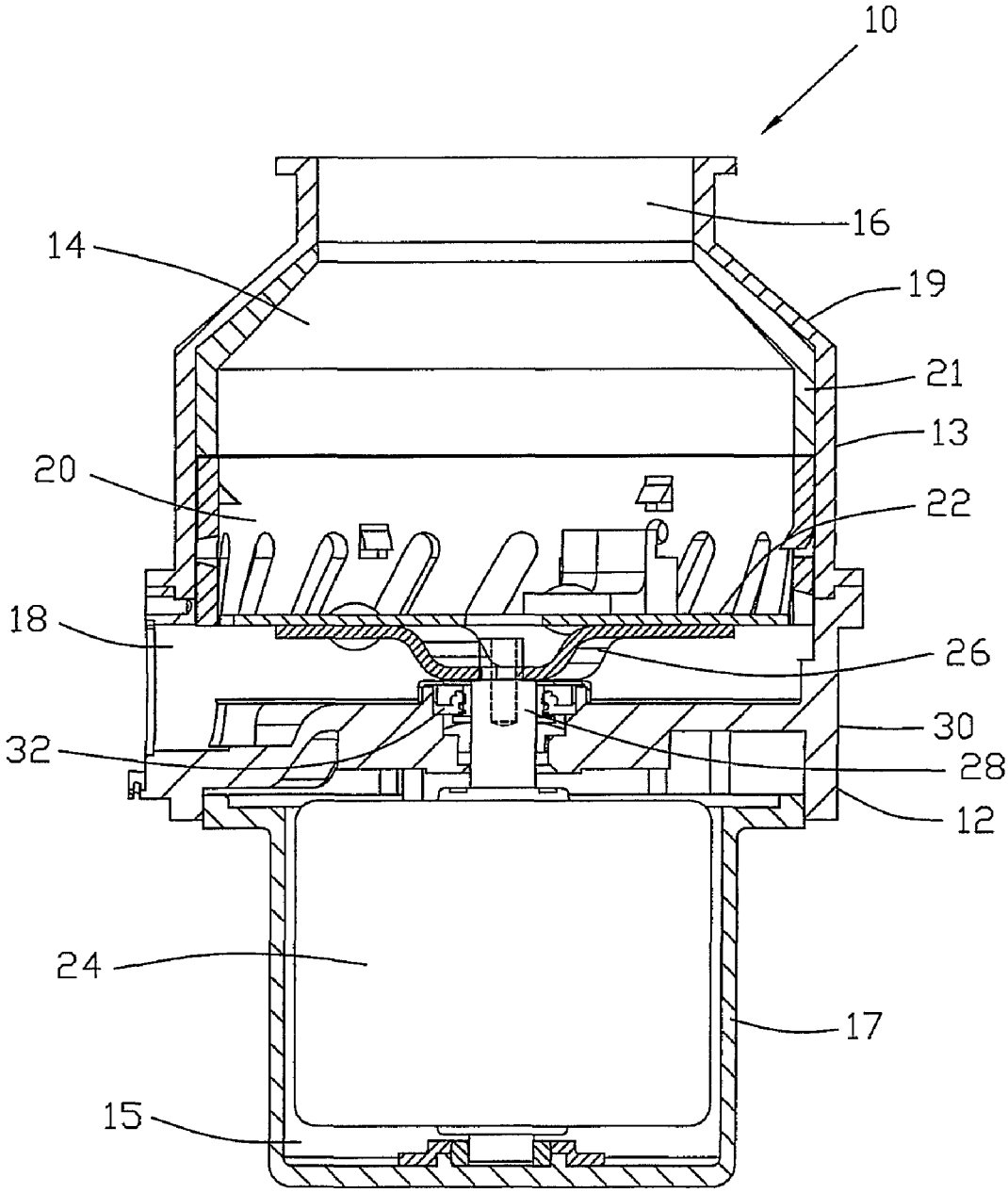
FIG. 1 is a sectional schematic view of a waste food disposer according to the present invention.

The preferred food waste disposer, as shown in FIG. 1, has a housing 12 which can be considered as being formed in three parts, an upper portion 13, a divider 30 and a lower portion 17. The upper portion 13 and divider 30 defines a grinding chamber 14, having an inlet 16 and an outlet 18. The inlet 16 is adapted to be fixed to the drain of a sink and the outlet is connected, in use, to a drain pipe for the removal of the waste. Located within the grinding chamber is a grinding mechanism including a shredder ring 20 and a grinding disc 22. Also located within the grinding chamber is a liner, as will be described below.

The grinding disc 22 is mounted on an output shaft 28 of an electric motor 24 by way of a mounting bracket 26. The motor 24, in this embodiment, is a high voltage DC motor, and is located in a motor compartment 15 of the housing which is separated from the grinding chamber by a divider 30. The output shaft 28 of the motor 24 passes through the divider 30. A seal assembly 32 provides a waterproof rotating connection between the divider 30 and the shaft 28. The divider 30 has an outer periphery which forms part of the housing 12 and the outlet 18.

The shredder ring 20 is fixed to the housing 12 within the grinding chamber 14. The shredder ring 20 is more clearly shown in FIG. 2. The shredder ring 20 is a ring of steel, preferably stainless steel and has a plurality of slots 33 extending upwardly from the lower edge of the ring forming large teeth 34. The slots 33 are not vertical but are slanted at an angle between 20° and 30° to the vertical so as to point the teeth 34 downwardly in the direction of rotation of the grinding disc 22 which is disposed, in use, within the shredder ring 20 and axially aligned with the teeth 34. The shredder ring 20 has a number of inwardly projecting fingers 36 located in the unslotted or upper portion of the shredder ring. In this embodiment, there are three fingers 36. The shredder ring 20 also has a number of inwardly projecting fingers 38 located in the slotted or lower portion of the ring, being formed in a respective tooth 34. Fingers 36 and fingers 38 help with the grinding process as will be described later. The fingers 36, 38 are thus formed in two rows which are axially separated.

Figure 2:
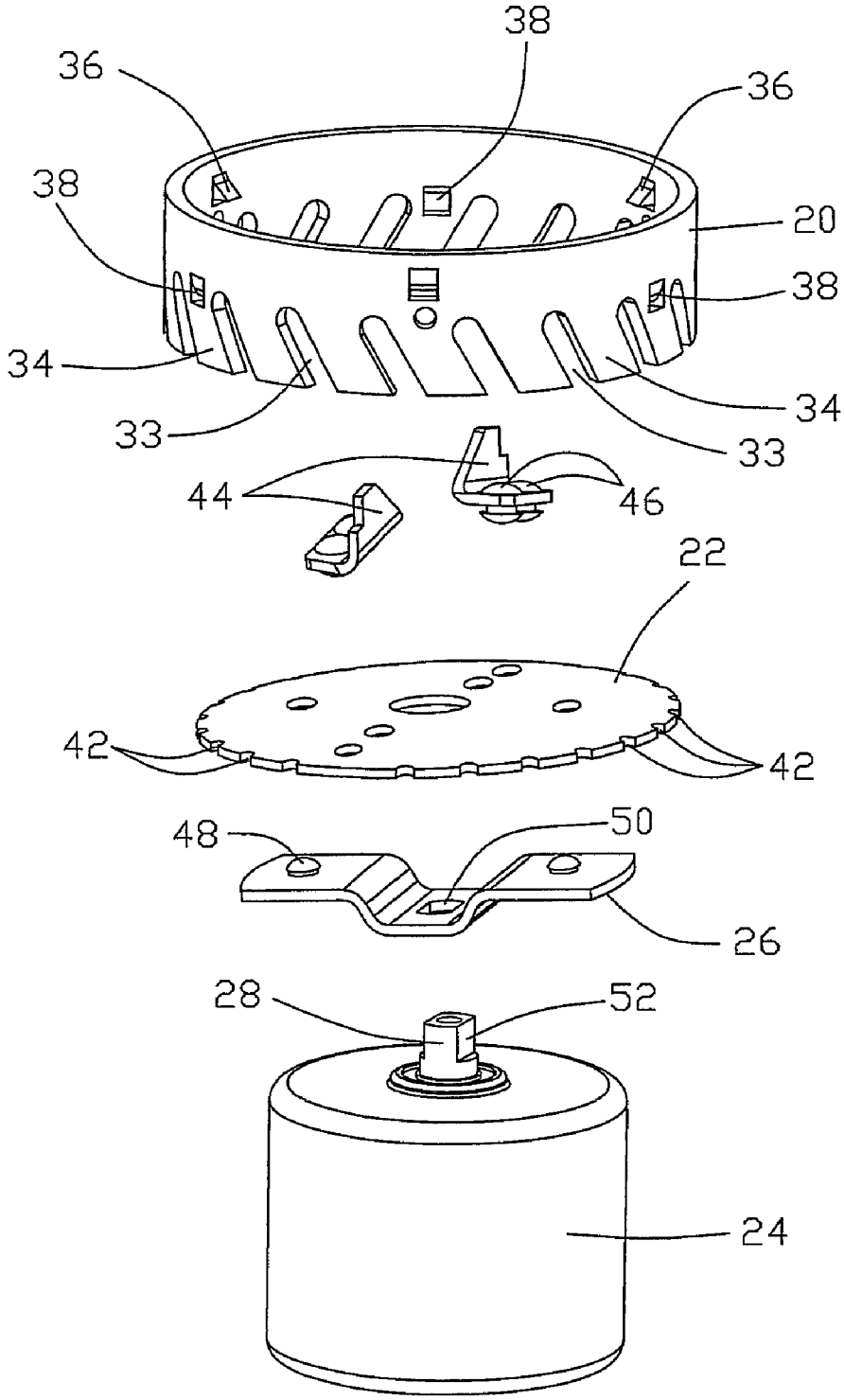
FIG. 2 is an exploded representation of the working parts of the disposer of FIG. 1.

The grinding disc 22 is more clearly shown in FIG. 2 The grinding disc 22 is preferably flat and has a plurality of peripheral recesses 42 which form teeth for aiding the shredding process. The grinding disc also has a number of pushers 44, two shown in this embodiment. The pushers are fixed to the disc and stand vertically and close to the periphery of the disc to help push the matter to be shredded to the slots 33 in the shredder ring 20. The pushers 44 shown in FIG. 2 are fixed pushers meaning that they are fixed to the grinding disc 22 and cannot move with respect to the grinding disc 22. They are each fixed by two rivets 46.

The mounting bracket 26 is fixed to the grinding disc 22 by rivets 48. The mounting bracket is a stepped bar as shown in FIG. 2 with a non-round hole 50 in the center which mates with and is keyed to the output shaft of the motor. In this embodiment, the output shaft has two flat sides 52. A spacer (not shown) and a screw (not shown) fix the mounting bracket 26 to the output shaft in known manner. The ends of the mounting bracket 26 extend up from the central region and are then bent back to follow the lower surface of the grinding disc 22.

Referring back to FIG. 1, operation of the waste food disposer will now be described. Water and food waste enters the grinding chamber 14 via the inlet 16. The water flows through the slots 33 in the shredder ring 20 and through the recesses 42 in the grinding disc to be discharged from the housing 12 via outlet 18. When the motor 24 is switched on, the output shaft 28 rotates the grinding disc at high speed to fling the matter towards the shredder ring and through the slots 33. Small particles of matter will pass through the slots 33 while large particles of matter will be caught and torn between the large teeth 34 of the shredder ring 20 and the recesses 42 on the disc, until the particles are small enough to pass through the slots 33. The pushers 44 help to fling the matter to the shredder ring 20 and add in the shredding of the matter. The fingers 36 and 38 do some minor shredding of softer matter but are used to stop large particles of matter from riding on the grinding disc and rubbing high on the shredder ring and thus, avoiding being caught by the teeth 34 of the shredder ring.

The liner 21 is disposed within the grinding chamber so as to protect certain parts of the housing upper portion 13 from direct contact with hard food waste particles such as bones and parts thereof. The liner 21, as shown in FIG. 1, extends from the top of the shredder ring and extends upwardly to the inlet 16. The housing upper portion has a lower section which is cylindrical, and which joins with the divider 30 and supports the shredder ring. The housing upper part also has a conical section which joins the cylindrical section to the inlet. The liner extends from the shredder ring 20 to the inlet 16 lining both the cylindrical section and the conical sections. However, it should be mentioned that as the hard waste matter tends to strike predominantly the cylindrical section, significant noise reduction can still be gained by lining only the cylindrical section. Indeed, this is shown in the embodiment of FIG. 3 in which the conical section of the housing upper portion is replaced by a horizontal section and the liner does not have the horizontal section.

Figure 3:
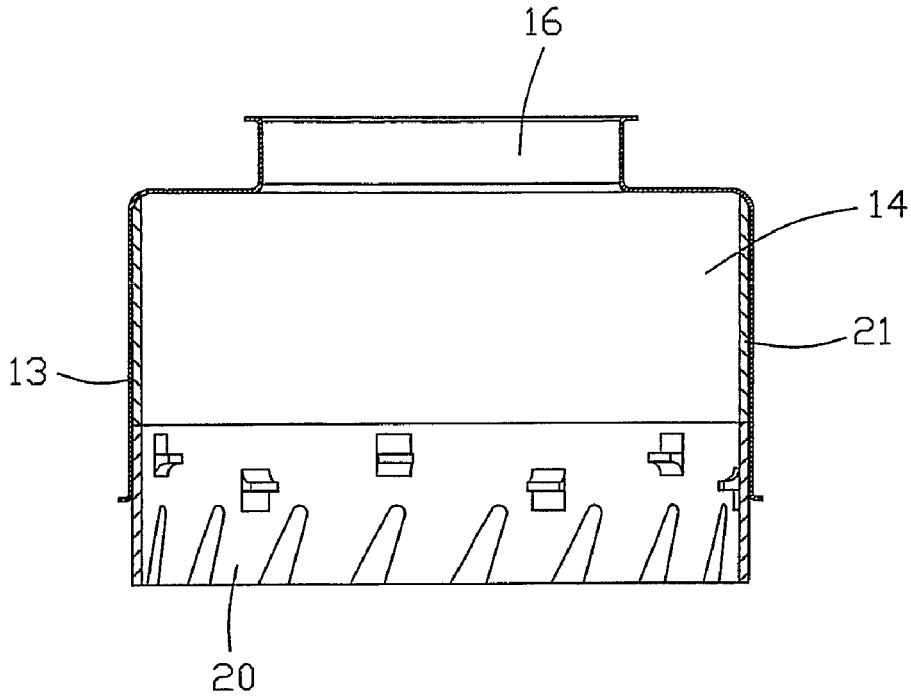
FIG. 3 is a sectional view of an alternate grinding chamber compared to the disposer of FIG. 1.
Figure 4:
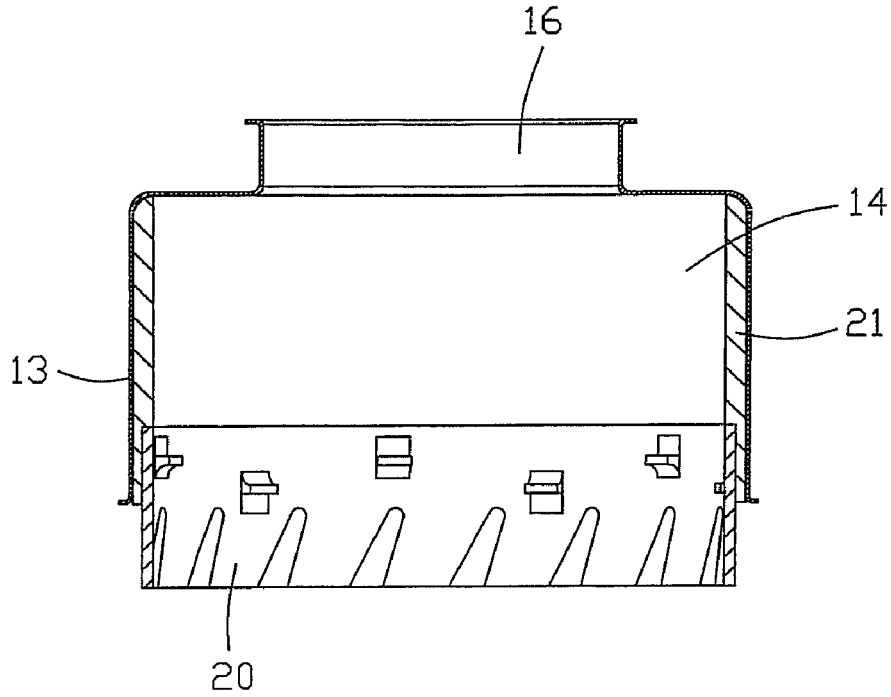
FIG. 4 is a sectional view of another alternate grinding chamber.

FIG. 4 is a modified version of the embodiment of FIG. 3. Here the housing upper portion is the same but the liner extends, at least partially, between the shredder ring 20 and the cylindrical section of the housing upper portion. The shredder ring is thus fitted to the housing upper portion via the liner.

Figure 5:
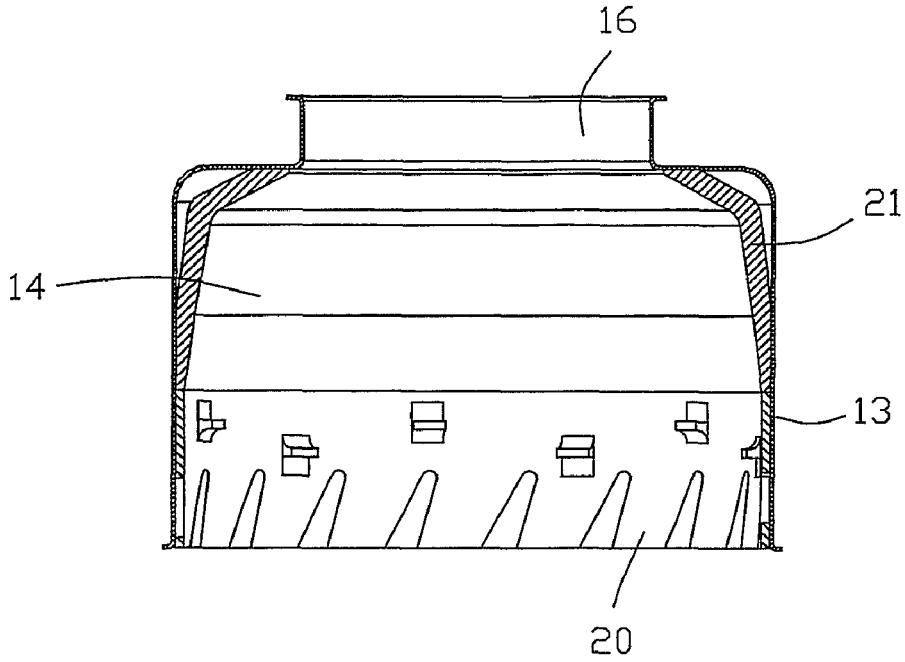
FIG. 5 is a sectional view of a further alternate grinding chamber.

FIG. 5 illustrates a further modified liner/housing arrangement. Here, again the housing upper portion is similar to that of FIGS. 3 and 4. However, the liner which extends from the upper edge of the shredder ring to the inlet, forms a double conical inner surface for the grinding chamber. This allows for easy cleaning of the interior of the grinding chamber by removing the "hidden" corners created by using the housing upper portion of FIGS. 3 and 4 which do not have the conical section. Also, it should be noted, that for purpose of reducing the impact noise, it is not necessary for the liner to be in direct and continuous contact with the housing upper portion. This is, however, desirable in most cases, in order to maximize the internal volume of the grinding chamber available for food waste.

The liner is preferably a plastics material which can withstand the harsh chemical environment of the grinding chamber as well as providing some cushioning of the impact from hard waste. Preferably, the plastics material is a high density plastic material as this has better impact and noise absorbing qualities.

The housing upper portion is preferably formed from a sheet metal material, ideally stainless steel sheet and formed by a stamping and/or drawing process. The grinding chamber may also have an additional inlet arranged for connection to a dishwasher or similar appliance.

Figure 6:
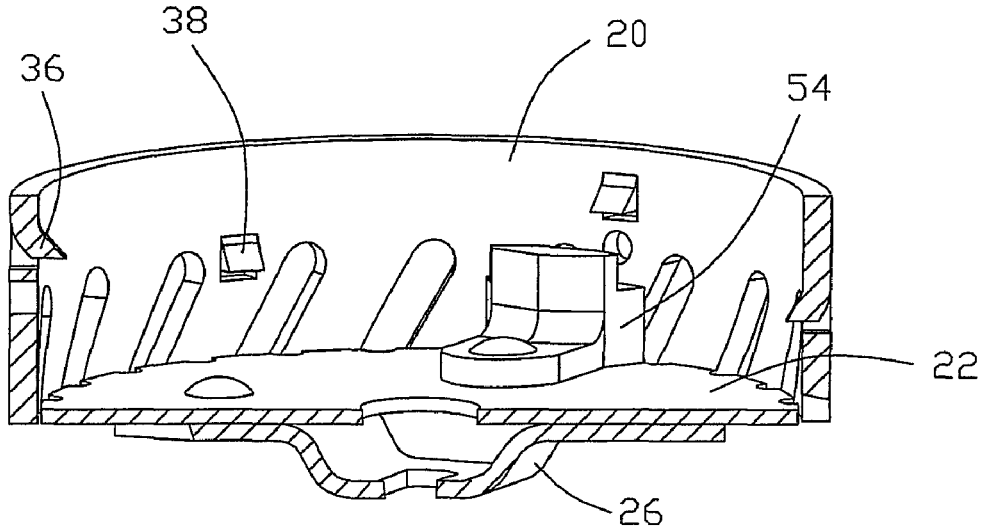
FIG. 6 is a sectional view of the grinding mechanism for a second embodiment.

FIG. 6 shows a flat grinding disc 21, according to another embodiment, where the grinding disc 22 has two swivel pushers 54. Swivel pushers are fixed to the grinding disc 22 for rotation therewith but they can rotate and/or slide about or along the fixing rivet. This has added value when dealing with hard matter such as bones, allowing the impact to be less forceful on the motor and the mounting structure and creating less noise for the user.

The shredder ring itself may be stepped and the pushers either fixed type or swivel type or combination type, partly fixed, partly swivel type, are correspondingly stepped to match the grinding interface and push the waste matter out to slots in the shredder plate.

Food waste disposal units made according to the present invention exhibit a quieter operation preventing or limiting large objects directly hitting the housing of the disposer.

The embodiments described above are given by way of example only and various modifications will be apparent to persons skilled in the art without departing from the scope of the invention as defined by the appended claims.

The invention claimed is:

1. A food waste disposer, comprising:

a metal housing defining a grinding chamber having an inlet for mounting on a drain of a sink and an outlet;

a grinding mechanism disposed within the housing including: a shredder ring; a grinding disc; and an electric motor, for rotating the grinding disc and having an output shaft; and a rigid noise reducing liner disposed within the grinding chamber adjacent an inner surface of the housing, the liner being an annular ring of hard plastic material.

2. The food waste disposer of claim 1, wherein the liner extends upwardly from an upper edge portion of the shredder ring.

3. The food waste disposer of claim 1, wherein the liner extends from the shredder ring to an upper edge portion of the grinding chamber.

4. The food waste disposer of claim 1, wherein the liner extends from the shredder ring to the inlet.

5. The food waste disposer of claim 1, wherein the plastics material is a high density plastics material.

6. The food waste disposer of claim 1, wherein an inner diameter of the liner matches an inner diameter of the shredder ring.

7. The food waste disposer of claim 1, wherein the grinding chamber has a portion which is conical and joins a lower cylindrical portion to the inlet, and the liner extends over the conical portion.

8. A food waste disposer according to claim 1, wherein the grinding chamber has a portion which is conical and joins a lower cylindrical portion to the inlet, and the liner does not extend over the conical portion.

9. The food waste disposer of claim 1, wherein the grinding disc has a number of swivel pushers for impacting on the waste.

10. The food waste disposer of claim 1, wherein the shredder ring has a plurality of fingers which extend inwardly into the interior of the grinding chamber at circumferentially spaced locations, at least some of the fingers being located at a different axial spacing than the other fingers.

11. The food waste disposer of claim 1, wherein the liner protects the housing from damage by hard particles.

12. The food waste disposer of claim 1, wherein the housing is structural and the liner is non-structural.

13. The food waste disposer of claim 1, wherein the metal housing is rigid.

14. A food waste disposer, comprising:

a metal housing defining a grinding chamber having an inlet for mounting on a drain of a sink and an outlet;

a grinding mechanism disposed within the housing including: a shredder ring; a grinding disc; and an electric motor, for rotating the grinding disc and having an output shaft; and a rigid noise reducing liner disposed within the grinding chamber adjacent an inner surface of the housing, the liner being an annular ring of hard plastic material in direct contact with the inner surface of the housing.

15. The food waste disposer of claim 14, wherein the liner protects the housing from damage by hard particles.

16. The food waste disposer of claim 14, wherein the housing is structural and the liner is non-structural.

17. The food waste disposer of claim 14, wherein the metal housing is rigid.

18. A food waste disposer, comprising:

a metal housing defining a grinding chamber having an inlet and an outlet;

a grinding mechanism disposed within the housing including: a shredder ring; a grinding disc; and an electric motor, for rotating the grinding disc and having an output shaft; and a rigid noise reducing liner disposed within the grinding chamber adjacent an inner surface of the housing, the liner being an annular ring of hard plastic material.

19. The food waste disposer of claim 18, wherein the liner is made of high impact absorbing material.

20. The food waste disposer of claim 18, wherein the metal housing is rigid.

* * * * *